US010330119B2

(12) United States Patent
Klein

(10) Patent No.: US 10,330,119 B2
(45) Date of Patent: Jun. 25, 2019

(54) METHOD FOR THE POSITIONING OF A COVER DISK OF A PUMP AND PUMP

(71) Applicant: Sulzer Management AG, Winterthur (CH)

(72) Inventor: Horst-Paul Klein, Lohmar (DE)

(73) Assignee: SULZER MANAGEMENT AG, Winterthur (CH)

( * ) Notice: Subject to any disclaimer, the term of this patent is extended or adjusted under 35 U.S.C. 154(b) by 610 days.

(21) Appl. No.: 14/955,403

(22) Filed: Dec. 1, 2015

(65) Prior Publication Data

US 2016/0169247 A1 Jun. 16, 2016

(30) Foreign Application Priority Data

Dec. 15, 2014 (EP) ..... 14197910

(51) Int. Cl.

| | |
|---|---|
| ***F04D 29/62*** | (2006.01) |
| ***F04D 1/00*** | (2006.01) |
| ***F04D 17/08*** | (2006.01) |
| ***F04D 29/22*** | (2006.01) |
| ***F04D 29/28*** | (2006.01) |
| ***F04D 29/42*** | (2006.01) |
| ***F04D 29/16*** | (2006.01) |

(52) U.S. Cl.

CPC ..... *F04D 29/624* (2013.01); *F04D 1/00* (2013.01); *F04D 17/08* (2013.01); *F04D 29/167* (2013.01); *F04D 29/22* (2013.01); *F04D 29/28* (2013.01); *F04D 29/426* (2013.01); *F04D 29/4206* (2013.01); *F04D 29/622* (2013.01); *F04D 29/628* (2013.01)

(58) Field of Classification Search

None

See application file for complete search history.

(56) References Cited

U.S. PATENT DOCUMENTS

| | | | | |
|---|---|---|---|---|
| 4,439,096 | A | 3/1984 | Rockwood et al. | |
| 6,887,034 | B2 * | 5/2005 | Mesiter | F04D 29/167 415/128 |

FOREIGN PATENT DOCUMENTS

| | | | |
|---|---|---|---|
| DE | 102012023734 | A1 | 6/2014 |
| WO | 9848173 | A1 | 10/1998 |
| WO | 2005009619 | A2 | 2/2005 |

OTHER PUBLICATIONS

Extended European Search Report dated May 28, 2015 in European Patent Application No. 14197910.4, Filed Dec. 15, 2014.

* cited by examiner

*Primary Examiner* — Kayla McCaffrey

(74) *Attorney, Agent, or Firm* — Global IP Counselors, LLP

(57) ABSTRACT

A method for the positioning of a cover disk with respect to an open impeller of a pump arranged in a pump housing. An adjustment bolt is first screwed so far into a threaded bore of the cover disk until it comes into contact with the pump housing. An identifier is subsequently applied which indicates a position of a first marking of the adjustment bolt. The adjustment bolt is then screwed in further until a second marking reaches the identifier. The described steps are repeated for at least one further adjustment bolt.

14 Claims, 1 Drawing Sheet

METHOD FOR THE POSITIONING OF A COVER DISK OF A PUMP AND PUMP

CROSS-REFERENCE TO RELATED APPLICATIONS

This application claims priority to EP Application No. 14197910.4, filed Dec. 15, 2014, the contents of which is hereby incorporated herein by reference.

BACKGROUND

Field of the Invention

The invention relates to a method for the positioning of a cover disk of a pump 3.

Background Information

With regard to pumps having a so-called open impeller, i.e., having an impeller with only one cover disk, the so-called inner cover disk, a second cover disk, the so-called outer cover disk, has to be positioned with respect to the impeller and fastened to a pump housing on the assembly of the pump. A conveying passage of the pump arises due to the arrangement of the outer cover disk, whereby a conveying or pumping of the conveying medium is made possible. In this respect, the cover disk should be positioned at a specific spacing from the pump wheel, wherein it is in particular important that a uniform spacing is set via the pump wheel. The setting of a uniform spacing is in particular difficult because the positioning takes place by means of a plurality of adjustment bolts whose settings have to be coordinated with one another. The positioning of the cover disk has previously been carried out by service technicians without special auxiliary means, which has in part resulted in positionings of the cover disk which are not ideal and not reproducible.

SUMMARY

In contrast to this, it is in particular the object of the invention to put forward a method for the positioning of a cover disk of a pump which enables an assembly of a pump having a particularly high degree of efficiency. It is furthermore in particular the object of the invention to put forward a pump having an open impeller, with the pump having a particularly high degree of efficiency. In accordance with the invention, this object is satisfied by a method having the features disclosed herein Having regard to the method in accordance with the invention for the positioning of a cover disk with respect to an open impeller of a pump arranged in a pump housing, with the pump in particular being a rotary pump, the cover disk and the pump housing are positioned with respect to one another first step, such that the cover disk comes into contact with the impeller and such that a desired spacing only has to be set in an axial direction between the cover disk and the impeller for reaching an end position of the cover disk. The axial direction is in this connection being understood as the direction which is fixed by the axis of rotation of the pump wheel and "comes into contact" is understood such that the cover disk can no longer be displaced in the axial direction further toward the impeller at any position. The cover disk is in this way arranged in such a way with respect to the pump housing that it only has to be positioned in the axial direction.

In a second step, a first adjustment bolt is screwed into a first threaded bore of the cover disk in particular designed as a through-hole until a bolt end of the first adjustment bolt comes into contact with a contact surface of the pump housing. The first adjustment bolt is in this respect only screwed in so far such that the cover disk continues to contact the impeller and does not yet lift off. In this respect, the turning in of the adjustment bolt in particular takes place manually, this means without the use of a tool, for example in the form of a wrench.

In a third step, an identifier which characterizes a position of a first marking in particular at a periphery of the first adjustment bolt is applied at the cover disk or at the pump housing. The identifier is in particular effected by means of a pen. However, it is also possible for the identifier to be carved in or to be effected by means of a label.

In a fourth step, the first adjustment bolt is turned in further until a second marking in particular at the periphery of the first adjustment bolt reaches the identifier at the cover disk or at the pump housing such that the desired spacing is set between the cover disk and the impeller.

The second to fourth steps are carried out for at least a second adjustment bolt and in particular also for a third and for a fourth adjustment bolt or for all other adjustment bolts. More than four adjustment bolts can also be used. The adjustment bolts in this respect have like threads, in particular like thread pitches. Furthermore, the first and second markings are arranged in a similar manner with respect to one another at the adjustment bolts, with a relative angular position of the two markings in particular being identical. All the adjustment bolts are in this way turned by the same angle in the fourth step, which, with an identical thread pitch, results in an identical displacement of the cover disk in the axial direction with respect to the pump housing at each adjustment bolt. A preferable spacing between the cover disk and the impeller can be fixed by a suitable selection of the thread pitch and of the arrangement of the first and second markings at the adjustment bolts. Only identical adjustment bolts are in particular used.

The method in accordance with the invention is in particular carried out such that the first step is carried out and subsequently the second step is carried out for all of the adjustment bolts, then the third step is carried out for all of the adjustment bolts and then the fourth step is carried out for all of the adjustment bolts. Mixed forms are, however, also possible. It is likewise possible that one or all of the adjustment bolts are already screwed a little into the threaded bores of the cover disk prior to the carrying out of the first step.

The adjustment bolts are in this respect in particular designed and have a corresponding pitch such that, in the fourth step, the adjustment bolts have to be screwed in between 20° and 90°, in particular by 70°, for setting the desired spacing. The second marking at the adjustment bolts is in this way arranged offset to the first marking between 20° and 90°, in particular by 70°, with respect to the direction of turning in.

In an embodiment of the invention, the first and second markings are made as notches at the periphery of the adjustment bolts and have different shapes, with a notch in particular being able to have a V shape, a rectangular shape or a rounded shape. The notches in particular extend in the axial direction over the complete outer thread of the adjustment bolts. The two markings can in this way be distinguished particularly easily, whereby a secure and reproducible positioning of the cover disk is enabled.

The two markings can be distinguished particularly easily when they have different colors.

In an embodiment of the invention, the adjustment bolts have a third and a fourth marking, with the third marking being made in a manner corresponding to the first marking and the fourth marking being made in a manner corresponding to the second marking and the arrangement or the angular offset of the fourth marking with respect to the third marking corresponding to the arrangement or to the angular offset of the second marking with respect to the first marking. It is in this way ensured that at least one first marking is always easily accessible and a simple positioning of the cover disk is possible in this way.

The markings do not necessarily have to be arranged at the periphery of the adjustment bolts. They could, for example, also be arranged at a bolt head of the adjustment bolts.

In an embodiment of the invention, the adjustment bolts are designed as sleeves in which fastening elements can be arranged, for example in the form of solid fastening bolts by means of which the cover disk is fastened to the pump housing in a fifth step. The fifth step is in this respect in particular only carried out then when the fourth step has been carried out for all of the adjustment bolts. A particularly simple and secure fastening of the cover disk at the pump housing is possible in this way.

In an embodiment of the invention, the desired spacing between the cover disk and the impeller amounts to between 0.1 and 0.3 mm, in particular to between 0.15 and 0.25 mm. A particularly high degree of efficiency of the pump is enabled in this way.

In an embodiment of the invention, the position of the adjustment bolts is secured at a reached desired spacing between the cover disk and the impeller, with the securing of the position of the adjustment bolts taking place by means of locking nuts. The locking nut is for this purpose tightened with respect to the side of the cover disk remote from the housing after the desired spacing has been reached. In this way, the position of the adjustment bolt is fixed, on the one hand, and any clearance which may be present in the connection between the cover disk and the adjustment bolt is eliminated, on the other hand. A particularly secure and exact setting and maintenance of the desired spacing is made possible in this way.

The object is also satisfied by a pump having a pump housing, having an open impeller arranged therein and having a cover disk for the impeller, wherein the cover disk has at least two threaded bores in which a respective adjustment bolt is arranged by which, starting from a contact of the cover disk at the impeller, a desired spacing between the cover disk and the impeller can be set, with bolt ends of the adjustment bolts only contacting contact surfaces of the pump housing on contact of the cover disk at the impeller and with the cover disk or the pump housing having identifiers at least during the setting of the desired spacing between the cover disk and the impeller, the identifiers characterizing a position of a first marking in particular at a periphery of the adjustment bolts on contact of the cover disk at the impeller and characterizing a position of a second marking in particular at the periphery of the adjustment bolts with a set desired spacing between the cover disk and the impeller, with the adjustment bolts having like threads and with the first and second markings being arranged in a similar manner with respect to one another at the adjustment bolts.

"At least during the setting of the desired spacing" is to be understood in this case such that the identifiers do not have to be present permanently at the cover disk or at the pump housing. The identifiers can be removed or can vanish during the use of the pump after the setting of the desired spacing and after the secure fastening of the cover disk to the pump housing.

Further advantages, features and details of the invention result with reference to the following description of embodiments and by means of the drawings in which elements which are the same or which have the same function are provided with identical reference numerals.

BRIEF DESCRIPTION OF THE DRAWINGS

The invention will be explained in more detail hereinafter with reference to the drawings.

DETAILED DESCRIPTION OF THE EMBODIMENTS

Figure 1:
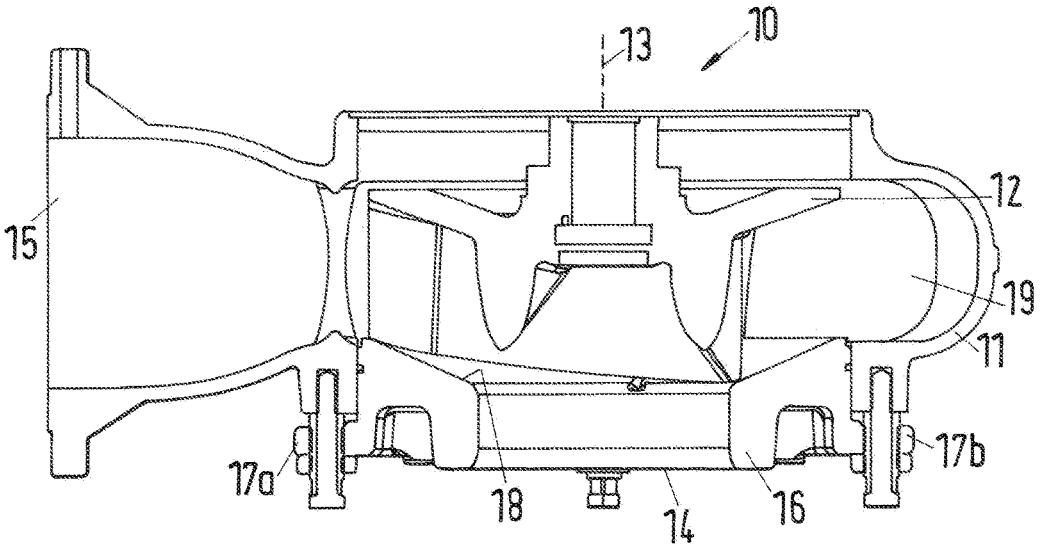
FIG. 1 is a rotary pump in a sectional representation.

In accordance with FIG. 1, a pump 10 in the form of a rotary or centrifugal pump has a pump housing 11 in which an open impeller 12 is arranged. The impeller 12 can rotate about an axis of rotation, which is aligned along an axial direction 13, and can be driven by a drive machine not shown, for example by an electric motor. A conveying medium, for example in the form of water, is supplied in the axial direction via an inlet 14 and is radially led off at elevated pressure via an outlet 15. A so-called cover disk 16 is arranged at a side of the impeller 12 remote from the inlet 14 and is fastened to the pump housing 11. The cover disk 16 has a predominantly ring-shaped basic shape with a total of four fastening eyelets 17*a*, 17*b* offset by 90°, of which two are shown in FIG. 1. The number of adjustment bolts is in this respect selected in dependence on the size of the pump 10 and on the pressure at the outlet 15. More or fewer adjustment bolts can in this way also be used. An inner surface 18 of the cover disk 16 aligned in the direction of the impeller 12 is in this respect designed inclined such that it is adapted to the contour of the impeller 12. The cover disk 16 forms a conveying passage 19 of the pump 10 together with the pump housing 11.

Figure 2:
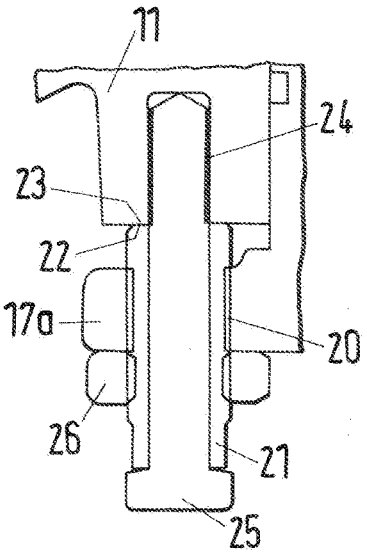
FIG. 2 is a detail of FIG. 1.

A first fastening eyelet 17*a* of the cover disk 16, which is shown enlarged in FIG. 2, has a first axially extending threaded bore 20 in the form of a through-hole having an inner thread not shown in detail. A first adjustment bolt 21 in the form of a sleeve having an outer thread not shown in detail is screwed into this threaded bore 20 such that a bolt end 22 of the adjustment bolt 21 contacts a contact surface 23 of the pump housing 11. The threaded bore 20 of the fastening eyelet 17*a* is in this respect flush with a threaded bore 24 in the form of a blind hole in the pump housing 11. A fastening bolt 25 projects through the adjustment bolt 21 and is screwed into the threaded bore 24 in the pump housing 11. A fixing of the cover disk 16 at the pump housing 11 is realized by means of the adjustment bolt 25. Furthermore, a locking nut 26 is arranged at the side of the cover disk 16 remote from the pump housing 11 at the adjustment bolt 21, with the locking nut tensioning the adjustment bolt 21 toward the fastening eyelet 17*a* of the cover disk 16 via the outer thread of the adjustment bolt 21. The design of the three other fastening eyelets and in particular of the used adjustment bolts, locking nuts and fastening bolts is identical.

In its end position, the cover disk 16 should be arranged at a fixed desired spacing from the pump wheel 12 of approximately between 0.1 and 0.3 mm, in particular between 0.15 and 0.25 mm. If the spacing is too small, a contact between the pump wheel 12 and the cover disk 16 may occur and in this way result in damage. If the spacing is too large or non-uniform, the degree of efficiency of the pump 10 is not ideal.

The desired spacing between the cover disk 16 and the pump wheel 12 has to be set on the assembly of the pump 10. For this purpose, the cover disk 16 is first positioned with respect to the pump housing 11 in a first step such that the threaded bores 20 of the fastening eyelets 17*a*, 17*b* are flush with the threaded bores 24 of the pump housing 11 and such that the cover disk 16 furthermore contacts the impeller 12. The impeller 12 could not rotate in this position of the cover disk 16 such that an axial displacement of the cover disk 16 is necessary. A suitable apparatus, not shown, can be used for the positioning of the cover disk 16.

In a subsequent second step, the total of four adjustment bolts 21 are manually screwed in so far into the threaded bores 20 of the fastening eyelets 17*a*, 17*b* that the bolt ends 22 of the adjustment bolts 21 come into contact with the contact surfaces 23 of the pump housing 11. The adjustment bolts 21 are in this respect only screwed in so far that the cover disk 16 continues to contact the impeller 12 and does not yet lift off.

Figure 3:
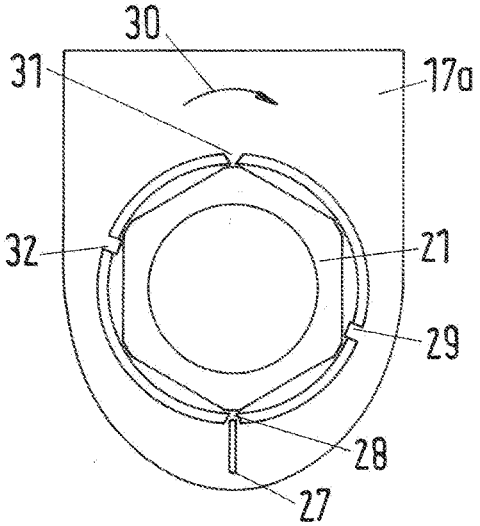
FIG. 3 is an adjustment bolt with a part of a cover disk of a rotary pump in a plan view.

In a subsequent third step, an identifier 27 which identifies a position of a first marking 28 at the periphery of the adjustment bolt 21 (see FIG. 3) is applied at the fastening eyelet 17*a* of the cover disk 12 using a pen. The first marking 28 has an outwardly open V-shaped contour and is marked in red, with the marking in red also being able to be dispensed with. It extends in the axial direction over the total length of the outer thread of the adjustment bolt 21. This is repeated for the three other adjustment bolts.

In a subsequent fourth step, the adjustment bolt 21 is screwed in further using a wrench until a second marking 29 at the periphery of the adjustment bolt 21 reaches the identifier 27 at the fastening eyelet 17*a* of the cover disk 12 (not shown). The desired spacing between the cover disk 16 and the impeller 12 is in this way set at this fastening eyelet 17*a*. The second marking 29 has an outwardly open rectangular contour and is marked in green. It extends in the axial direction over the total length of the outer thread of the adjustment bolt 21. This is repeated for the three other adjustment bolts.

The second marking 29 is in this respect arranged offset to the first marking 28 by 70° with respect to the direction of screwing in 30. The second marking can also be offset with respect to the first marking to a lesser or greater degree. The adjustment bolt 21 furthermore has a third marking 31 disposed diametrically opposite the first marking 28 and has a fourth marking 32 disposed diametrically opposite the second marking 29. The third marking 31 has an identical V-shaped design and an identical color identifier as the first marking 28. The fourth marking 32 has an identical rectangular design and an identical color identifier as the second marking 29. In this way, the identifier at the cover disk 16 can also be effected at the third marking 31 in the third step and, in the fourth step, the adjustment bolt 21 can subsequently be screwed in until the fourth marking is reached. The set spacing between the cover disk 16 and the pump wheel 12 is then the same as in the procedure described above.

The locking nuts 26 are subsequently screwed onto the adjustment bolts 21 and tensioned with respect to the fastening eyelets 17*a*, 17*b*. In a fifth step, the fastening bolts 24 are finally screwed into the threaded bores 24 of the pump housing 11 such that the adjustment bolts 21 are pressed against the pump housing 11. The cover disk 16 is in this way connected to the pump housing 11 and the same desired spacing between the cover disk 16 and the pump wheel 12 is set and maintained everywhere by the adjustment bolts 21.

The pump 10 has the identifier 27 at least during the setting of the desired spacing between the cover disk 16 and the impeller 12. The identifier 27 can be removed after the cover disk 16 has been fixedly connected to the pump housing 11.

The invention claimed is:

1. A method for the positioning of a cover disk with respect to an open impeller of a pump arranged in a pump housing, the method comprising:

positioning the cover disk and the pump housing with respect to one another such that the cover disk comes into contact with the pump housing at the impeller and such that a predetermined spacing only has to be set in an axial direction between the cover disk and the impeller for reaching an end position of the cover disk;

screwing a first adjustment bolt into a first threaded bore of the cover disk until a bolt end of the first adjustment bolt comes into contact with a contact surface of the pump housing, with the cover disk continuing to contact the impeller;

applying an identifier at the cover disk or at the pump housing, the identifier identifying a position of a first marking of the first adjustment bolt;

screwing in the first adjustment bolt until a second marking of the first adjustment bolt reaches the identifier such that the predetermined spacing between the cover disk and the impeller is thereby set;

screwing a second adjustment bolt into a second threaded bore of the cover disk until a bolt end of the second adjustment bolt comes into contact with the contact surface of the pump housing, with the cover disk continuing to contact the impeller;

applying a second identifier at the cover disk or at the pump housing, the second identifier identifying a position of a first marking of the second adjustment bolt; and screwing in the second adjustment bolt until a second marking of the second adjustment bolt reaches the second identifier such that the predetermined spacing between the cover disk and the impeller is thereby set, the first and second adjustment bolts having like threads comprising first and second markings made as notches at a periphery of the respective adjustment bolt and have different shapes and wherein the first and second adjustment bolts being arranged in a similar manner with respect to one another at the first and second adjustment bolts.

2. A method in accordance with claim 1, wherein the positioning the cover disk is carried out manually.

3. A method in accordance with claim 1, wherein the applying the first and second identifiers includes applying the first and second identifiers with a pen.

4. A method in accordance with claim 1, wherein the first and second markings at the periphery of the respective adjustment bolt have different colors.

5. A method in accordance with claim 1, wherein each of the first and second adjustment bolts has a third marking and a fourth marking, with the third marking being made in a manner corresponding to the first marking and the fourth marking being made in a manner corresponding to the second marking and the arrangement of the fourth marking with respect to the third marking corresponding to the arrangement of the second marking with respect to the first marking.

6. A method in accordance with claim 1, wherein at least four adjustment bolts are used.

7. A method in accordance with claim 1, wherein the pump is a rotary pump.

8. A method in accordance with claim 1, wherein the adjustment bolts are sleeves in which fastening elements are configured to be arranged by which the cover disk is fastened to the pump housing.

9. A method in accordance with claim 1, wherein positioning the cover disk includes positioning the cover disk such that the predetermined spacing is between 0.1 and 0.3 mm.

10. A method in accordance with claim 1, further comprising securing the position of the adjustment bolts at the predetermined spacing between the cover disk and the impeller.

11. A method in accordance with claim 10, wherein the securing of the position of the adjustment bolts is by locking nuts.

12. A pump comprising:

a pump housing having an open impeller arranged therein and having a cover disk for the impeller, the cover disk having at least two threaded bores in which a respective adjustment bolt is arranged by which, starting from a contact of the cover disk at the impeller, a predetermined spacing between the cover disk and the impeller is set, with bolt ends of the adjustment bolts only contacting contact surfaces of the pump housing on contact of the cover disk at the impeller and with the cover disk or the pump housing having identifiers at least during the setting of the predetermined spacing between the cover disk and the impeller, the identifiers identifying a position of a first marking of the adjustment bolts on contact of the cover disk at the impeller and identifying a position of a second marking of the adjustment bolts with the predetermined spacing between the cover disk and the impeller, with the adjustment bolts having like threads, the adjustment bolts furthermore comprising first and second makings made as notches at a periphery of a respective adjustment bolt and have different shapes, and the first and second markings being arranged in a similar manner with respect to one another at the adjustment bolts.

13. A method in accordance with claim 1, wherein positioning the cover disk includes positioning the cover disk such that the predetermined spacing is between 0.15 and 0.25 mm.

14. A method in accordance with claim 2, wherein the applying the first and second identifiers includes applying the first and second identifiers with a pen.

* * * * *